US005908139A

United States Patent [19]

Pearson

[11] Patent Number: 5,908,139

[45] Date of Patent: Jun. 1, 1999

[54] MEDICATION DELIVERY CARTRIDGE

[76] Inventor: Walter G. Pearson, P.O. Box 4371, Pineville, La. 71361-4371

[21] Appl. No.: 09/060,229

[22] Filed: Apr. 14, 1998

[51] Int. Cl.[6] ..... B65H 1/00

[52] U.S. Cl. ..... 221/197; 221/278

[58] Field of Search ..... 221/197, 211, 221/278, 282, 92, 123, 131

[56] References Cited

U.S. PATENT DOCUMENTS 3,333,731 8/1967 Katz ..... 221/197

4,817,818 4/1989 Lookhart ..... 221/197

*Primary Examiner*—Kenneth Noland

*Attorney, Agent, or Firm*—Domingue, Delaune & Waddell

[57] ABSTRACT

A medication delivery cartridge for dispensing consumable medical supplies is provided, comprising a base; a hollow guide member, preferably in the shape of a tube, removably connectable to the base by a guide sleeve, wherein the guide member is shaped and dimensioned to contain a plurality of medical supply containers; and attachment means on the base for allowing the cartridge to be installed within a medication delivery system. The hollow guide member preferably includes an indexing device for aligning the guide member with the base. Each of the medical supply containers may include a lifting device attached thereto for allowing temporary attachment to the probe of the delivery system. Where a magnetic probe is employed, each of the lifting devices includes a ferrous material sufficient to allow magnetic attachment of the probe to the lifting device. The medical supply containers are stacked end to end within a medication tube, and the medication tube is inserted into the guide member. For alignment purposes the medication tube may further include a plurality of alignment elements disposed therealong, the alignment elements resulting in slidable contact with the guide member when the medication tube is inserted therein. Each cartridge further includes identifying indicia operatively attached to the cartridge, such as to the medication tube or the guide member, corresponding to a particular type of medical supply container and readable by the medication delivery system. In a preferred embodiment, the identifying indicia comprises a bar code.

12 Claims, 3 Drawing Sheets

MEDICATION DELIVERY CARTRIDGE

BACKGROUND OF THE INVENTION

I. Field of the Invention

The present invention relates generally to medication delivery systems, and more particularly to cartridges and specially designed unit dose and multi-dose medication used for filling automated medication delivery systems.

II. Description of Prior Art

Medication in the form of vials, ampules and other containers is often packaged in boxes and drawers from which medical personnel can retrieve them as needed for a patient. Many such vials are intended for a single use and are referred to as unit dose medications. Other such vials may be used several times and are referred to as multi-dose medications. For example, these containers often hold liquid medication that is used in syringes for injections, and some might contain powders that can be rehydrated with water for oral consumption. The packaging of such medications in unit doses is advantageous for a variety of reasons. Individually sealed containers prevents spoilage of larger quantities of unused medication, and there is a substantially lesser risk of overdose due to the limited amount within the vials. Also, small containers of medication allow for longer storage of the medication for use over extended periods of time, and it helps to prevents medical care personnel from having to touch the medication before it is delivered to a patient. This is especially important in situations where the medical care personnel are handling numerous types of medication, and where patients may have a hypersensitivity to certain medications. Although most of the small containers used in pharmacies and hospitals contain liquid and powder forms of medication, a wide variety of medical items are similarly packaged, such as syringes and other consumable medical supplies. Because most of the containers referred to above are cylindrical in shape, the ensuing description will employ the word "vials" for all such similarly shaped containers. It should be understood, however, that use of the word "vials" is only for the sake of simplicity, and is not intended as a limitation on the invention as it will be described herein.

Because of their relatively nonuniform shape, especially at the tops and bottoms of the vials, automated delivery of vials has been an elusive goal. Automated medication dispensing devices have been developed for certain forms of medication, namely the dispensing of single pills from bulk containers, such as my prior invention represented by U.S. Pat. No. 5,292,029, the disclosure of which is incorporated herein by reference. In that device, single pills are retrieved from a bulk container by a suction probe that is capable of traveling along three axes. The shape of the probe and the individual pills makes retrieval by suction quite reliable. In theory, it is possible to retrieve a single vial by suction, but only if the vial is oriented so that a flat portion of the vial, such as the lid, is substantially perpendicular to the suction probe. Therefore, a bulk container having multiple, unusually oriented unit dose vials would not be a viable container for such medication if retrieval of single vials is desired.

Another attempt to resolve the problems in retrieving unit dose medications has been made in another of my prior applications, Ser. No. 08/948,284. That invention deals primarily with the retrieval of unit dose "blister packs" containing pills. In that invention, a specially designed cartridge was developed which allows for alignment of the packages and retrieval by suction or other means within an automated medication delivery system. As will be appreciated herein, the present invention is similar in that a specially designed cartridge is employed to allow retrieval of vials within the same automated medication delivery system.

Consequently, there is a broad need for the automatic dispensing of single unit dose or multi-dose medication vials, especially in connection with automated devices such as my prior patent mentioned above. One means of allowing for such automated dispensing is to provide a cartridge which houses a plurality of vials which are oriented in a manner to facilitate retrieval by suction or other means, such as magnetic means. The cartridge should be readily alignable and attachable within an automated delivery system so as to allow retrieval of vials, preferably without modification to any existing suction probe unit and without any other major functional and structural changes to the delivery system. The cartridges should be relatively simple and inexpensive to manufacture by the medication supplier so that pre-filled cartridges may be provided to users of the automated delivery system. A bar code or other means of identifying the medication should be conveniently located on the cartridge so that the automated delivery system can correlate the particular medication type with a specific location within the automated delivery system.

SUMMARY OF THE INVENTION

It is therefore an object of this invention to provide a medication delivery cartridge which is capable of holding a plurality of unit dose or multi-dose medication vials.

It is also an object of this invention to provide a medication delivery cartridge which is simple and inexpensive to manufacture so that it can be pre-loaded by the medication supplier.

It is a further object of this invention to provide a medication delivery cartridge which can be installed for use within an automated medication delivery system.

Yet another object of this invention is to provide a medication delivery cartridge which allows trouble-free retrieval of medication vials.

These and other objects and advantages of the present invention will no doubt become apparent to those skilled in the art after having read the following description of the preferred embodiment which are contained in and illustrated by the various drawing figures.

Therefore, in a preferred embodiment, a medication delivery cartridge for dispensing consumable medical supplies is provided, comprising a base; a hollow guide member, preferably in the shape of a tube, removably connectable to the base, wherein the guide member is shaped and dimensioned to contain a plurality of medical supply containers; and attachment means on the base for allowing the cartridge to be installed within a medication delivery system. The hollow guide member preferably includes indexing means for aligning the guide member with the base. In one embodiment, the indexing means comprises a tab extending from the guide member, wherein the tab is matably engageable with a notch formed into the base. Optionally, the base further includes a guide sleeve extending therefrom, wherein the guide sleeve is shaped and dimensioned to matably engage the guide member.

To enable secure attachment of the medical supply containers to the probe within the medication delivery system, each of the medical supply containers preferably includes lifting means attached thereto for allowing temporary attachment to the probe. Where a magnetic probe is employed, each of the lifting means includes a ferrous material sufficient to allow magnetic attachment of the probe to the lifting means. In the preferred embodiment, the medical supply containers are stacked end to end within a medication tube, and the medication tube is shaped and dimensioned for insertion into the guide member. For the purposes of maintaining alignment between the guide member and the medication tube, the medication tube may further include a plurality of alignment elements disposed therealong, the alignment elements being shaped and dimensioned to slidably contact the guide member when the medication tube is inserted therein.

Each cartridge further includes identifying indicia operatively attached to the cartridge, such as to the medication tube or the guide member, corresponding to a particular type of medical supply container and readable by the medication delivery system. In a preferred embodiment, the identifying indicia comprises a bar code.

DETAILED DESCRIPTION OF THE PREFERRED EMBODIMENTS

Figure 1:
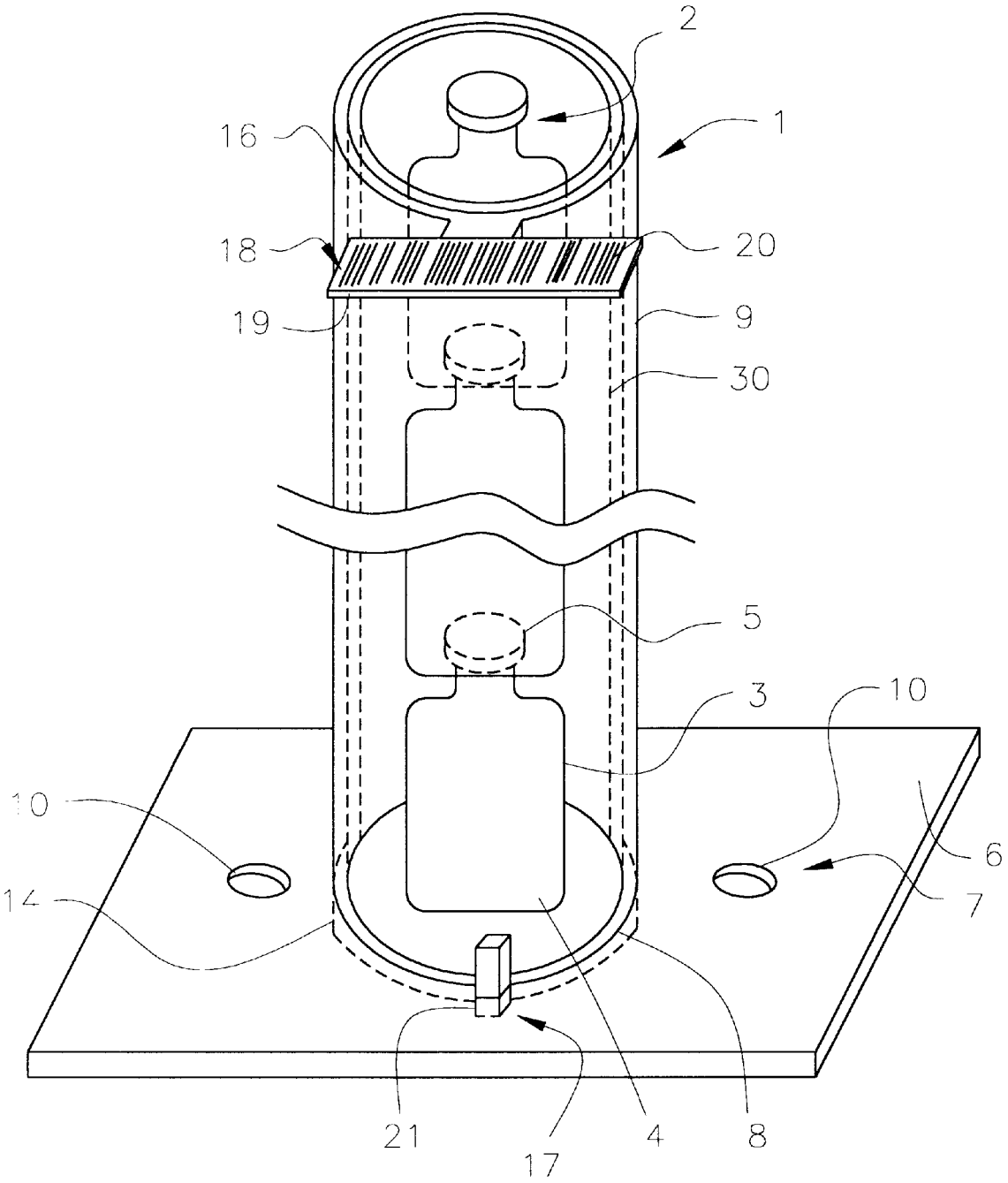
FIG. 1 is a perspective view of a preferred embodiment of the present invention, depicting the stacking of vials within the medication delivery cartridge.

Turning now to FIG. 1, a perspective view of a preferred embodiment 1 of the medication delivery cartridge is shown depicting one possible orientation of a medication vial 2. Only three medication vials 2 are shown within the cartridge 1 for clarity in both FIGS. 1 and 2, and the views are "broken" to show both the top and bottom of the invention. However, it will be understood that any number of such vials 2 may be contained therein, limited only by the height of the cartridge 1 and/or the automated delivery system. Each vial 2 comprises a cylindrically shaped body 3 having a base 4, as well as a sealed cap 5, as is common for such medication as used in the prior art.

Figure 2:
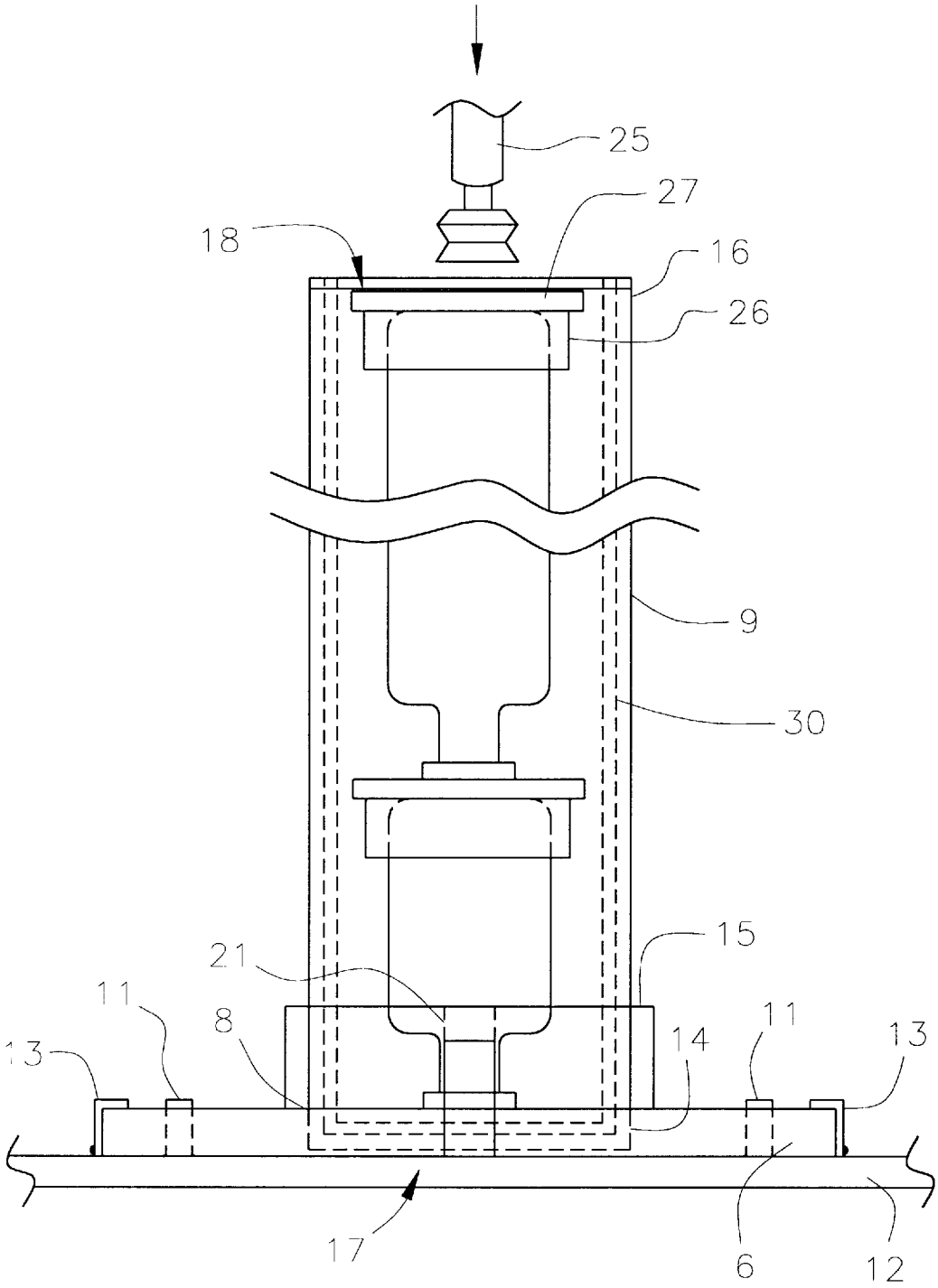
FIG. 2 is an elevation view of the embodiment of FIG. 1, wherein the vials are stacked upside down and employing a vial retrieval attachment.

As shown in FIG. 1, the cartridge 1 generally includes a base 6 having first indexing means 7 and a recess 8 formed into the base 6 capable of accepting a guide tube 9. Base 6 is preferably constructed in a manner that permits reliable interconnection with an automated medication delivery system 12, such as that described earlier herein. For example, as shown in FIGS. 1 and 2, one possible embodiment of first indexing means 7 is a pair of holes 10 formed into base 6 which are capable of matable engagement with a corresponding pair of pegs 11 protruding from the medication delivery system 12. Additionally, or as an alternative, base 6 may be secured by one or more clips 13 pivotally connected to the automated delivery system 12 such that the base 6 is prevented from upward motion therefrom. The aforedescribed embodiments of first indexing means 7 are only two examples of a wide variety of mechanical arrangements which will satisfy the requirements of: (1) keeping base 6 properly positioned with respect to the automated delivery system 12, and (2) preventing unwanted motion of the cartridge during operation or movement of the system 12.

Recess 8 preferably comprises a cylindrical depression into base 6 which matably receives the bottom portion 14 of guide tube 9, as illustrated in FIG. 1. In addition, or possibly as an alternative, to recess 8, a cylindrical guide sleeve 15, best shown in FIGS. 2 and 3, may extend from base 6 to receive the guide tube 9. Guide sleeve 15 serves not only to establish the precise two dimensional position of the guide tube 9 with respect to the base 6, but also helps to minimize any deviation of the top portion 16 of guide tube 9 from its required position and keeps the guide tube 9 in a relatively stable position during medication retrieval. Either recess 8 or guide sleeve 15, or both, preferably include second indexing means 17 for the purpose of establishing the proper angular orientation of the guide tube 9 relative to base 6. Proper angular orientation is required, because guide tube 9 preferably includes identifying indicia 18 as described below. Although the specific embodiment of second indexing means 17 is not particularly important, one possible device is a simple notch 21 extending away from the circumferential edge of the recess 8 or the guide sleeve 15. Notch 21 is capable of matable engagement with a corresponding tab 22 formed onto guide tube 9. Thus, when guide tube 9 is inserted into recess 8 and/or guide sleeve 15, tab 22 is matched to notch 21 to establish the correct angular orientation of guide tube 9 so that the indicia 18 are readable along the path of the probe 25 of the automated delivery system 12.

To enable identification of the particular medication in each guide tube 9, each guide tube 9 includes some form of identifying indicia 18 which is readable by the automated delivery system 12. For example, as shown in FIG. 1, a short indicia support member 19 extends from the guide tube 9 and includes a unique bar code 20 corresponding to a particular type and dosage of medication within the guide tube 9. Although bar code indicia is preferred, any other convenient means of automatically associating the particular medication, such as a magnetic strip having similar information, would be appropriate. Once the guide tubes 9 are installed, the automated delivery system 12 is programmed to scan each indicia 18 and record into memory the identifying data 20 read therefrom, thereby establishing the identification of the particular medication available at each discrete location within the automated delivery system 11. Alternatively, the identifying indicia 18 may be placed on the medication tubes 30 themselves, for example by the medication manufacturer, so that each pre-loaded medication tube 30 can readily be scanned once it has been placed within the guide tube 9.

In FIG. 1, the medication vials 2 are shown oriented in an upright position so that the cap 5 is facing up. This orientation is suitable for retrieval of the vials 2 as long as the probe 25 of the delivery system 12 can adequately become attached to the cap 5. For example, in the case of a probe 25 operated through suction generated by a vacuum pump (not shown), the cap 5 would require sufficient surface area to enable a secure attachment for lifting the vial 2 and carrying it to a drop area. Similarly, in the case of a probe 25 operated through a powered magnet, the cap 5 would require a minimum amount of ferrous material to allow a secure magnetic attachment. However, given the wide assortment of medications, it is preferable for each vial 2 or other container to be equipped with a lifting attachment 26 for use with probe 25. In general, lifting attachment 26 may be any device which attaches to a medication vial 2 or other container which enables probe 25 to establish a secure connection and reliably transport the medication to the drop area within the automated delivery system 12. The lifting attachment 26 should be inexpensive to manufacture and install, and it can either be removable or permanently attached to the medication container. In one embodiment suited to use with vials 2 in FIG. 2, the lifting attachment 26 may be a cylindrical cap having a relatively large end surface area 27. In this arrangement, the vials 2 are placed upside down with the tube with the lifting attachment 26 secured to the bottom 4 of the vials 2. Thus, a suction probe 25 would have ample surface area to grip the container as described earlier herein. If a magnetic probe 25 is employed, the end of the lifting attachment 26 could also include an embedded or surface-attached portion of ferrous-based material to enable magnetic gripping of the container. If the lifting attachments 26 are inexpensive enough, they may simply be disposed of with the container after use of the medication. However, it is also possible that they can be reused with other containers.

Figure 3:
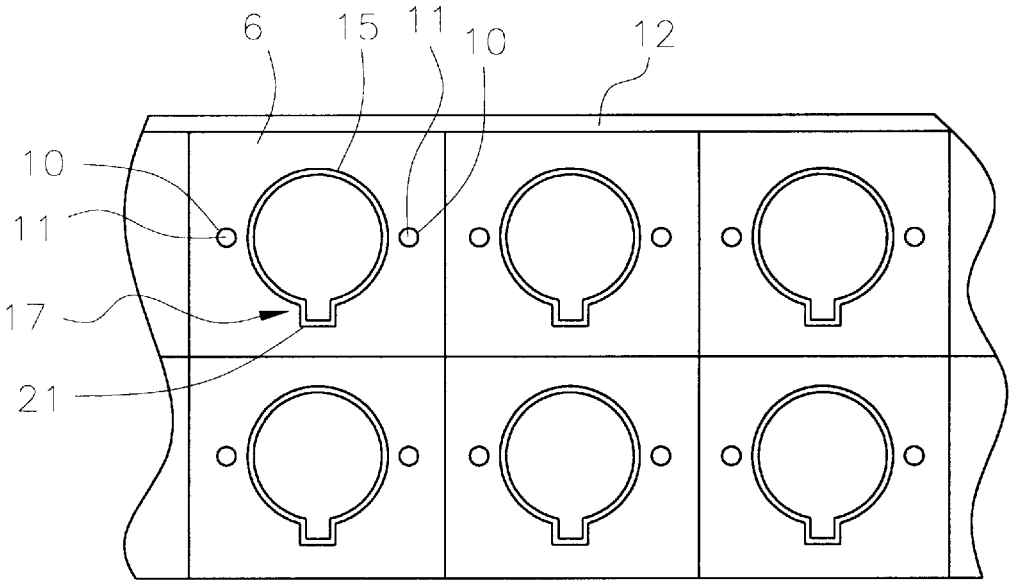
FIG. 3 is a top view of several of the cartridges installed in an array within an automated medication delivery system.

FIG. 3, in a top view, depicts one manner in which the medication delivery cartridges 1 may be installed within the automated delivery system 12. A typical installation would entail placement of the cartridges 1 in a rectangular array within the enclosure of the delivery system 12. It should be understood that any number of such cartridges 1 may used within the delivery system 12, wherein the individual cartridges 1 may each be a different size and contain different medication.

Figure 4:
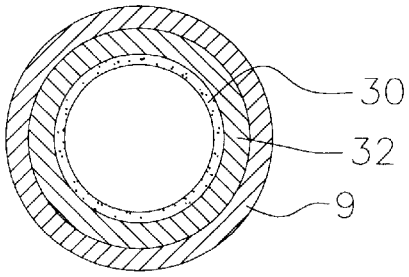
FIG. 4 is a top cross-sectional view of a cartridge containing concentric smaller diameter tubes.
Figure 5:
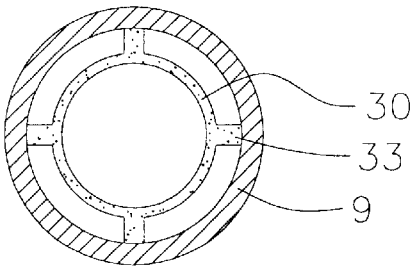
FIG. 5 is a top cross-sectional view of a cartridge containing a smaller diameter tube with alignment elements.

FIGS. 4 and 5, by way of cross-sectional views, illustrate two ways in which the medication tube 30, which actually contains the vials 2 or other containers of medication, can be used in connection with the guide tube 9 of the cartridge 1. For example, in FIG. 4, a medication tube 30, which has an open end and a closed bottom, contains a plurality of vials 2 and can be inserted into the guide tube 9. If the outside diameter of the medication tube 30 is significantly smaller than the inside diameter of the guide tube 9, then an intermediate tube 32 may be employed so as to preserve the concentricity, or the coaxial alignment, of the medication tube 30 and the guide tube 9. In other words, the intermediate tube 32 would merely act as a "filler" tube for the aforestated purpose. In FIG. 5, an alternate arrangement is shown which eliminates the use of any intermediate tube 32 because of the use of alignment ribs 33 formed along the outside surface of the medication tube 30. Alignment ribs 33 protrude a predetermined radial distance from the outside cylindrical surface of the medication tube 30 such that the medication tube 30 fits smoothly within guide tube 9 and with the required axial alignment. From the foregoing description, it can be seen that the inside diameter of guide tube 9 can be set to a particular dimension, and that medication tubes 30 can have alignment ribs 33 of differing distances depending upon the size of the medication containers it carries. For example, a medication tube 30 having large vials 2 may require no alignment ribs 33, because its outside diameter closely matches the inside diameter of guide tube 9. On the other hand, another medication tube 30 may carry narrow syringes, whereupon radially larger alignment ribs 33 are required to maintain concentricity. This arrangement would permit the manufacturer of an automated delivery system 12 to standardize its guide tube 9 size, while medication manufacturers could deliver medication in preloaded medication tubes 30 which are specifically designed to fit within the guide tubes 9. Therefore, use of the present invention would be made extremely simple, because each pre-loaded medication tube 30 could be quickly installed within the delivery system 12 by health care personnel.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

I claim:

1. A medication delivery cartridge for dispensing consumable medication supplies, comprising:

(a) a base;

(b) a hollow guide member removably connectable to said base, wherein said guide member is shaped and dimensioned to contain a plurality of medical supply containers, and wherein said guide member includes indexing means for aligning said guide member with said base; and (c) attachment means on said base for allowing said cartridge to be installed within a medication delivery system.

2. The medication delivery cartridge of claim 1, wherein said indexing means comprises a tab extending from said guide member, wherein said tab is matably engageable with a notch formed into said base.

3. The medication delivery cartridge of claim 1, wherein said medication supply containers are stacked end to end within a medication tube, and wherein said medication tube is shaped and dimensioned for insertion into said guide member.

4. The medication delivery cartridge of claim 3, wherein said medication tube further includes a plurality of alignment elements disposed therealong, said alignment elements being shaped and dimensioned to slidably contact said guide member when said medication tube is inserted therein.

5. A medication delivery cartridge for dispensing consumable medication supplies, comprising:

(a) a base;

(b) a hollow guide member removably connectable to said base, wherein said guide member is shaped and dimensioned to contain a plurality of medical supply containers; and (c) attachment means on said base for allowing said cartridge to be installed within a medication delivery system;

wherein each of said medical supply containers includes lifting means attached thereto for allowing temporary attachment to a probe within said medication delivery system.

6. The medication delivery cartridge of claim 5, wherein said lifting means includes a ferrous material sufficient to allow magnetic attachment of said probe to said lifting means.

7. The medication delivery cartridge of claim 5, wherein said medication supply containers are stacked end to end within a medication tube, and wherein said medication tube is shaped and dimensioned for insertion into said guide member.

8. The medication delivery cartridge of claim 7, wherein said medication tube further includes a plurality of alignment elements disposed therealong, said alignment elements being shaped and dimensioned to slidably contact said guide member when said medication tube is inserted therein.

9. A medication delivery cartridge for dispensing consumable medication supplies, comprising:

(a) a base;

(b) a hollow guide member removably connectable to said base, wherein said guide member is shaped and dimensioned to contain a plurality of medical supply containers;

(c) attachment means on said base for allowing said cartridge to be installed within a medication delivery system; and (d) identifying indicia operatively attached to said cartridge corresponding to a particular type of said medical supply container and readable by said medication delivery system.

10. The medication delivery cartridge of claim 9, wherein said identifying indicia comprises a bar code.

11. The medication delivery cartridge of claim 9, wherein said medication supply containers are stacked end to end within a medication tube, and wherein said medication tube is shaped and dimensioned for insertion into said guide member.

12. The medication delivery cartridge of claim 11, wherein said medication tube further includes a plurality of alignment elements disposed therealong, said alignment elements being shaped and dimensioned to slidably contact said guide member when said medication tube is inserted therein.

* * * * *